United States Patent [19]

Exel

[11] Patent Number: 4,832,348

[45] Date of Patent: May 23, 1989

[54] THROWING GAME APPARATUS

[76] Inventor: Christian Exel, c/o Michael Dainard Associates, Inc., 920 Broadway, New York, N.Y. 10010

[21] Appl. No.: 137,695

[22] Filed: Dec. 24, 1987

[30] Foreign Application Priority Data

May 20, 1987 [AT] Austria ..... 1294/87

[51] Int. Cl.[4] ..... A63B 71/02

[52] U.S. Cl. ..... 273/344; 273/412

[58] Field of Search ..... 273/344, 412, 417; 446/473; 16/114 R, 114 A

[56] References Cited

U.S. PATENT DOCUMENTS

| | | | |
|---|---|---|---|
| 2,745,666 | 5/1956 | Swartz | 273/344 |
| 2,771,294 | 11/1956 | McChesney | 273/344 X |
| 3,378,260 | 4/1968 | Hartel | 273/344 |
| 3,954,266 | 5/1976 | Carrano et al. | 273/412 X |
| 4,634,193 | 1/1987 | Liv | 16/114 R X |
| 4,735,420 | 4/1988 | Seidler | 273/412 |

*Primary Examiner*—Edward K. Look
*Assistant Examiner*—Joseph M. Pitko
*Attorney, Agent, or Firm*—Wolder, Gross & Yavner

[57] ABSTRACT

A throwing game consisting of a shuttlecock-like throwing body having a suction cup on its top and a catch plate having a cambered front side and a holding loop on its rear side. The holding loop is insertable and fixable in a clamping device on the rear side. The holding loop is provided with a series of spaced nubs, which allow the size of the loop to be adjusted.

4 Claims, 2 Drawing Sheets

THROWING GAME APPARATUS

The present invention relates to an athletic toy for children and adults and, more particularly, to a throwing game incorporating a shuttlecock-like throwing body provided with a suction cup on its top and a catch plate of plastic material provided with a holding member.

A battledore or paddle for shuttlecock-like throwing bodies with suction cups on their tops is known from DE-PS No. 11 73 824. Such a battledore is provided with a holding member in the form of a handle similar to that of a tennis racket or pingpong paddle. The battledore is provided with a completely smooth catching surface on one side, while the reverse side is formed as a striking surface with grooves or holes which prevent the retaining of the throwing body on the striking surface. If the player wants to change, from catching to striking the throwing body or vice versa, he has to turn the paddle handle or his hand by 180 degrees. In addition, as the handle is held by the player, removal of the throwing body from the catching surface is often injurious to the throwing body, as the player is inclined to remove the throwing body from the catching surface vertically and perpendicular to the catching surface, which requires high energy and increases the possibility of damaging the throwing body suction cup.

It is accordingly an object of the present invention to provide a throwing game of the type described in which the throwing body has improved adhesion to the catching surface than a planar catching surface and, due to the arrangement and embodiment of the holding member, can be easily and efficiently removed from the catch plate.

This and other objects are achieved by providing a catch plate having a cambered catching surface on the front side and arranging the holding member on the rear side. By cambering the front side of the catch plate, adhesive power is increased. At the same time, catch plate rigidity is increased; the catch plate cannot bend or sag even at comparatively low wall thicknesses such as is the case with a planar surface. In addition, the release of the catch plate from a mold during production of the catch plate is also facilitated. By the arrangement of the holding member on the rear side of the catch plate, the player will remove the throwing body from the catch plate in a lateral direction, which prevents wear of the suction cup and requires less energy.

The catch plate may be formed in any of a variety of configurations, such as an ellipse, a star, a triangle, or circle to increase the skill level and difficulty of play.

According to a preferred embodiment of the invention, the holding member is formed as a holding loop provided at each of its ends with a narrow extension of rectangular cross-section. The extension is provided with pairs of nubs on and spaced from its end. The rear side of the catch plate is provided with a pair of spaced-apart projections or clamp members, each having a clamping groove with a relatively narrow neck widening at its bottom into which a holding loop extension can be inserted by its narrow side and can be fixed by a 90 degree rotation, one of the nubs serving as a stop. This construction allows for simplified replacement of the catch plate, as well as adjustments to the width of the hand of the player.

The invention is explained in detail in the following description of a preferred, but nonetheless illustrative, embodiment taken in conjunction with the accompanying drawings as follows.

Figure 1:
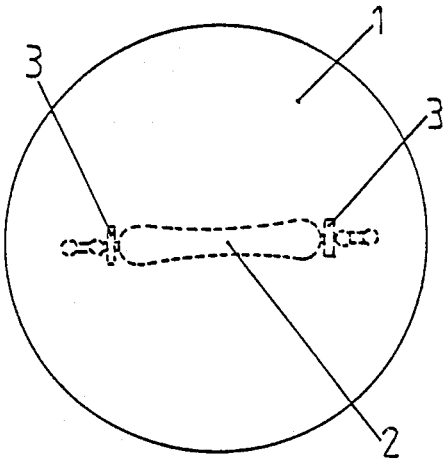
FIG. 1 is a front plan view of a catch plate according to the invention.
Figure 2:
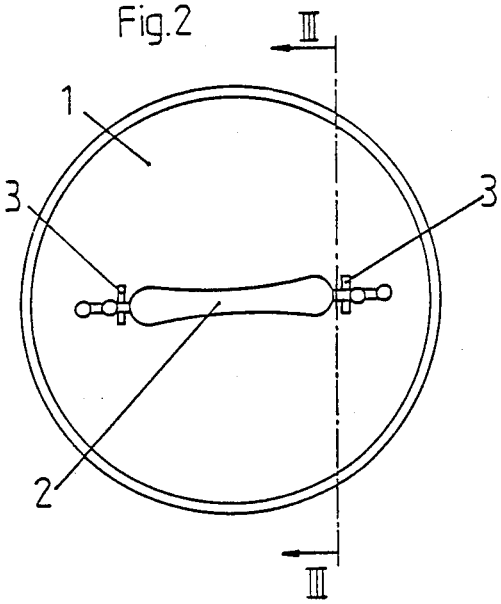
FIG. 2 is a rear plan view of the catch plate of FIG. 1.
Figure 3:
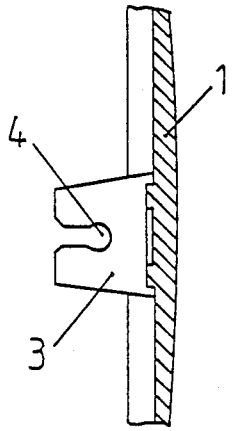
FIG. 3 is a sectional view along lines III—III of FIG. 2 illustrating the clamping device for the holding loop.

Referring to FIGS. 1 and 2, a circular catch plate may alternatively have the shape of an ellipse, a star or a triangle for increasing the difficulties of playing. The catch plate 1 is provided on its rear side with a holding member in the form of a holding loop 2 which is fixed, preferably exchangeably, in a clamping device located on the catch plate. As seen in FIGS. 2 and 3, the clamping device may consist of two spacially-arranged projections 3.

Each projection 3 has a clamping groove 4 which is widened at its interior, for instance, circularly as shown. As may also be seen in FIG. 3, the catch plate 1 is cambered on its front side. The catch plate 1 is made of plastic material, which assures light weight and thus easier handling.

Figure 4:
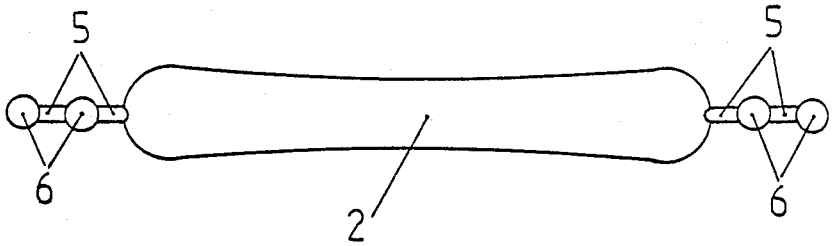
FIG. 4 is a plan view of the holding loop.

The holding loop 2, shown in FIG. 4, has a narrow extension of rectangular cross-section on each end which is provided with a pair of nubs 6 at its distal end and spaced therefrom. The narrow side of extension 5 can be inserted in the clamping groove 4 and fixed therein by rotation through 90 degrees, with nub 6 as a stop to longitudinal movement. Three adjusting possibilities for the effective length of the holding loop 2 are thus available, representing configurations where the clamps are both positioned between the nubs, where one clamp is between the nubs and the other between a nub and the hand-grip portion, and where both grips are between the nub and hand-grip portion. By renewed rotation by 90 degrees, the extension 5 can be pulled out of the clamping groove 4, either for adjustment of the length of the holding loop 2 to the appropriate hand size or in order to change the catch plate 1 for another catch plate.

Figure 5:
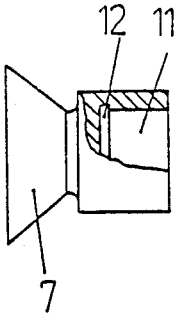
FIG. 5 is a side elevation view of the suction cup part of the throwing body.
Figure 6:
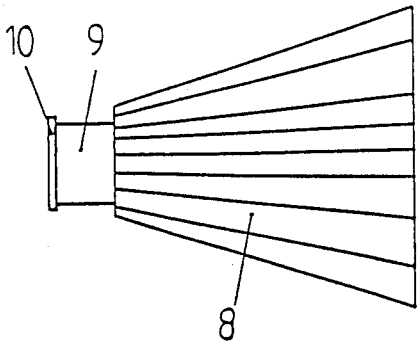
FIG. 6 is a side elevation view of the shuttlecock part of the throwing body.

The throwing body consists of a suction cup part 7, as shown in FIG. 5, and a shuttlecock part 8, as shown in FIG. 6, the shuttlecock part having a cylindrical lug 9 with collar 10 insertable into a cylindrical recess 11 with inner peripheral groove 12. The suction cup part 7 is formed of rubber, and preferably, a silicone rubber compound, as known in the art.

The game is played, for instance, by the players each throwing a throwing body to each other at the same time, catching them, removing them from the catch plate and throwing them back. Since the game is based on speed, reaction speed, concentration and condition are trained.

I claim:

1. An apparatus for a throwing game having a shuttlecock-like throwing body having a suction cup on its top and a catch plate of plastic material provided with a holding member, characterized in that the catch plate is formed with front and rear surfaces, said front surface being cambered on its front side and said holding member being mounted to said rear surface, further characterized in that the holding member comprises a holding loop having a pair of opposed ends, each of said ends having a narrowed extension of rectangular cross-section, each of said ends having a plurality of hubs, the rear surface of said catch plate having a pair of two spacially-arranged projections having a clamping groove adapted to grip said extension.

2. The game of claim 1, wherein one of said nubs is located at the distal end of said extension.

3. The game of claim 1, wherein said clamping groove comprises a neck section adapted to accept the narrow side of said extension and an enlarged bottom portion to allow 90 degree rotation of said extension therein whereby said extension is retained therein.

4. The apparatus of claim 1, wherein said front surface of said catch plate is in the form of a circle.

* * * * *